US005878628A

United States Patent [19]

Ongaro et al.

[11] Patent Number: 5,878,628

[45] Date of Patent: Mar. 9, 1999

[54] MARINE CONTROL ARM WITH KNURL INSERT AND METHOD FOR MAKING SAME

[76] Inventors: Frank Ongaro, 5969 Carversville Rd., Doylestown, Pa. 18901; Rosalyn Jean, 6309 Angus Dr., Vancouver, B.C. V6m 3P4, Canada

[21] Appl. No.: 622,748

[22] Filed: Mar. 27, 1996

[51] Int. Cl.[6] ..... G05G 1/04

[52] U.S. Cl. ..... 74/548; 74/523

[58] Field of Search ..... 74/548, 545, 543, 74/553, 523; 16/DIG. 12, DIG. 24, DIG. 41, DIG. 30

[56] References Cited

U.S. PATENT DOCUMENTS

| | | | |
|---|---|---|---|
| 1,568,883 | 1/1926 | Danielson | 16/DIG. 30 X |
| 1,710,452 | 4/1929 | Drolette et al. | 74/543 X |
| 1,811,086 | 6/1931 | Kasch | 16/DIG. 30 X |
| 2,496,700 | 2/1950 | Cole | 74/543 |
| 2,501,008 | 3/1950 | Schramm | 74/548 |
| 3,000,660 | 9/1961 | Lewis, Jr. | 74/548 X |
| 3,484,808 | 12/1969 | Conterno | 74/543 |
| 3,986,409 | 10/1976 | Tripp et al. | 74/548 |
| 5,025,826 | 6/1991 | Schoepe et al. | 16/DIG. 30 X |

*Primary Examiner*—Charles A. Marmor
*Assistant Examiner*—Mary Ann Battista
*Attorney, Agent, or Firm*—Reed Smith Shaw & McClay LLP

[57] ABSTRACT

A marine control arm formed from an elongated arm member having a hollow shell with first, second, third and fourth internal guides. Each of the internal guides extends from an outer surface of the hollow shell to an inner surface of the hollow shell. The first and second internal guides are separated by a first distance, and the third and fourth internal guides are separated by a second distance. The control arm includes an insert having a plurality of knurls for mating with grooves in a throttle assembly. The insert has first and second wings for positioning the insert within the hollow shell. The first wing has a first width corresponding to the first distance, and the second wing has a second width corresponding to the second distance. The insert has an inner surface and an outer surface and is rigidly affixed to the elongated arm member within the hollow shell such that the first wing is positioned between the first and second guides, the second wing is positioned between the third and fourth guides, the inner surface of the hollow shell is positioned against the inner surface of the insert, and the outer surface of insert is positioned flush with the outer surface of the hollow shell.

9 Claims, 5 Drawing Sheets

MARINE CONTROL ARM WITH KNURL INSERT AND METHOD FOR MAKING SAME

FIELD OF THE INVENTION

The present invention is directed generally to throttles and clutches for controlling the operation of marine motors and transmissions. More particularly, the present invention is directed to control arms for positioning throttles and clutches used for controlling the drive train of a marine motor.

BACKGROUND OF THE INVENTION

Marine motors and transmissions are typically controlled by throttles and clutches that are adjusted or moved by a pilot or captain during operation of a boat. Each throttle generally includes a control arm that is connected to a throttle assembly which, in turn, is connected via a cable to a marine engine. Similarly, each clutch typically includes a control arm that is connected to a clutch assembly which, in turn, is connected via a cable to a marine transmission. These control arms generally include a knob at one end which can be grasped by the pilot or captain in order to vary engine speed or direction.

Each control arm typically includes knurls (or ridges) for coupling the control arm to either a throttle or clutch assembly. More particularly, each control arm typically includes a round knurl socket with ridges that mate with corresponding grooves a throttle or clutch assembly when the control arm and the throttle or clutch assembly are interconnected. The knurls or ridges in the knurl socket are usually quite small, and typically have a height which is on the order of a millimeter.

In order for the knurl socket in the control arm to function properly, it is critical that the socket have a roundness that matches the round contour of the throttle or clutch assembly to which the control arm will be connected. In addition, it is critical that the knurls or ridges in the socket be present in a proper dimension.

When certain metals are cast into parts (and, in particular, when stainless steel is cast into parts), the shrinkage of the part within a mold will vary unevenly if the weight of the part is not evenly distributed throughout the mold. Since a knurl socket is typically of a greater mass than the remaining portion of its associated control arm, it is difficult to cast both the knurl socket and the control arm in a single piece without uneven shrinkage occurring during the casting process. Such uneven shrinkage will typically result in a loss of roundness in the knurl socket of the control arm.

In addition, the dimension of each knurl in the socket (typically on the order of a single millimeter in height) is substantially smaller than the handle portion of the control arm which will often be about eight inches in dimension. Given the relatively large size of the handle portion in relation to the knurls, it is difficult to cast both handle portion and the knurls in a single casting. This difficulty arises from the fact that the fluidness of metal decreases during the casting process as the metal begins to cool. Since the knurl socket is located at one end of the control arm, it is likely that some or all of the individual knurls in the socket might not cast if the knurl socket and the control arm are formed in a single casting.

Marine control arms and knobs are typically positioned near the steering wheel of a craft, and are often positioned at locations which expose the control arms and knobs to the outside elements such as ultraviolet radiation from the sun, wind and rain. In order for a pilot or captain to clearly distinguish between the throttle and clutch during operation of a boat, the knob used for controlling the marine throttle is generally labeled with the color red, and the knob used for controlling the marine clutch is generally labeled with the color black. However, as a result of exposure to the outside elements, these control knobs often lose some or all of their initial coloration. Control knobs with deteriorated coloring are unsightly. More importantly, however, when the control knobs have deteriorated coloring, it is more difficult for a pilot or captain to distinguish between the throttle and clutch during operation of a boat.

It is therefore an object of the present invention to provide a marine control arm with a round knurl socket in which all of the knurls in the socket have been properly cast.

It is a further object of the present invention to provide control knobs which are easily distinguishable and which do not lose coloration as a result of exposure to the outside elements.

It is a still further object of the present invention to provide control knobs which are distinguishable not only by virtue of their color, but also as a result of their surface feel and texture.

It is a still further object of the present invention to provide improved control knobs which can be used in connection with existing control arms as replacements for deteriorated knobs which may be affixed to such control arms.

These and other objects and advantages of the invention will become more fully apparent from the description and claims which follow or may be learned by the practice of the invention.

SUMMARY OF THE INVENTION

The present invention is directed to a marine control arm formed from an elongated arm member having a hollow shell with first, second, third and fourth internal guides. Each of the internal guides extends from an outer surface of the hollow shell to an inner surface of the hollow shell. The first and second internal guides are separated by a first distance, and the third and fourth internal guides are separated by a second distance. The control arm includes an insert having a plurality of knurls for mating with grooves in a throttle assembly. The insert has first and second wings for positioning the insert within the hollow shell. The first wing has a first width corresponding to the first distance, and the second wing has a second width corresponding to the second distance. The insert has an inner surface and an outer surface and is rigidly affixed to the elongated arm member within the hollow shell such that the first wing is positioned between the first and second guides, the second wing is positioned between the third and fourth guides, the inner surface of the hollow shell is positioned against the inner surface of the insert, and the outer surface of insert is positioned flush with the outer surface of the hollow shell.

BRIEF DESCRIPTION OF THE DRAWINGS

In order that the manner in which the above-recited and other advantages and objects of the invention are obtained and can be appreciated, a more particular description of the invention briefly described above will be rendered by reference to a specific embodiment thereof which is illustrated in the appended drawings. Understanding that these drawings depict only a typical embodiment of the invention and are not therefore to be considered limiting of its scope, the invention and the presently understood best mode thereof will be described and explained with additional specificity and detail through the use of the accompanying drawings.

DETAILED DESCRIPTION OF THE INVENTION

Figure 1:
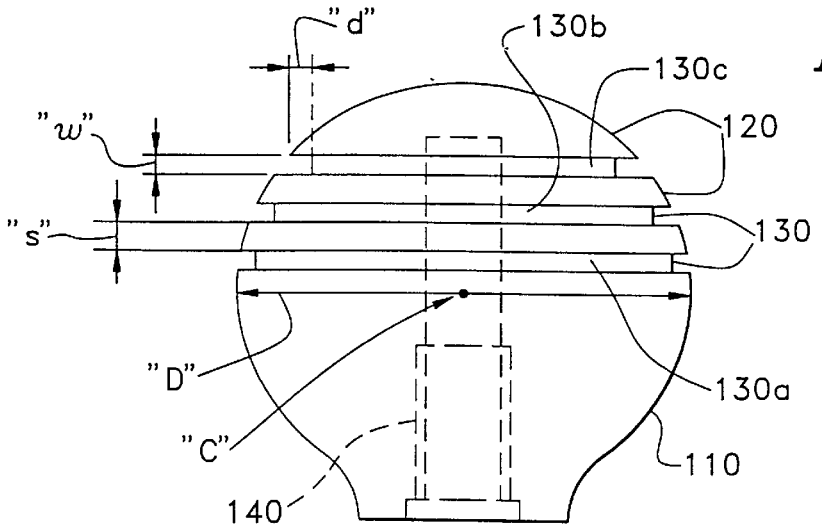
FIG. 1 is a front view of an improved marine control knob, in accordance with a preferred embodiment of the present invention.

Referring now to FIG. 1, there is shown an isometric view of an improved marine control knob 100, in accordance with a preferred embodiment of the present invention. Control knob 100 has a generally spherical outer surface 110 which is preferably made of polished stainless steel. The generally spherical outer surface 110 is formed from unindented surfaces 120 and indented surfaces 130. The indented surfaces 130 are generally closer to the geometric centroid ("C") of the control knob 100 than the unindented surfaces 120. The indented surfaces 130 have a colorized pigment deposited thereon. As a result of their indented positioning, the indented surfaces 130 are protected from the outside elements and colorized pigment deposited on indented surfaces 130 therefore does not fade or deteriorate over time as a result of exposure to such elements.

When the control knob 100 is used for controlling a marine throttle, the colorized pigment deposited on indented inner surfaces 130 is preferably red. Similarly, when the control knob 100 is used for controlling a marine clutch, the colorized pigment deposited on indented inner surfaces 130 is preferably black. In the preferred embodiment, colorized pigment is deposited only on the indented surfaces 130 and not on any of the unindented surfaces 120.

In the preferred embodiment of control knob 100, the outer surface 110 has a diameter "D" of about 9/16", although it will be understood by those skilled in the art that the diameter of outer surface 110 may be larger or smaller than this dimension. Also in the preferred embodiment, the distance "d" between each unindented surface 120 and each indented surface 130 is generally 1/32" to 3/32." Thus, the unindented surfaces 120 will generally be 1/32" to 3/32" closer to the centroid "C" than the unindented surfaces 130. In a still further preferred embodiment, the distance "d" between each unindented surface 120 and each indented surface 130 is 1/16".

Referring still to FIG. 1, in the preferred embodiment of control knob 100, indented surfaces 130 are formed from first, second and third concentric rings 130*a*, 130*b*, 130*c*. The width "w" of each concentric ring 130*a*, 130*b*, 130*c* is preferably between 1/32" and 5/32." In a still further preferred embodiment, the width "w" of each concentric ring 130*a*, 130*b*, 130*c* is 1/8". In addition, in the preferred embodiment, the space "s" between each of the respective concentric rings 130*a*, 130*b*, 130*c* is preferably between 3/32" and 7/32." In a still further preferred embodiment, the space "s" between each of the respective concentric rings 130*a*, 130*b*, 130*c* is 5/32". It will be understood by those skilled in the art that patterns other than concentric circles may be used to form indented surfaces 130.

In an alternate preferred embodiment of the present invention, a control knob 100 having indented surfaces 130 formed of concentric rings 130*a*, 130*b*, 130*c* is used only for the marine throttle, and a control knob with no indented surfaces is used for the marine clutch. Since the indented surfaces 130 will impart a different feel or texture to control knob 100 which would not be present if the outer surface 110 of the control knob was entirely smooth, use of the indented surfaces 130 on the throttle control knob in this way will allow the boat pilot or captain to distinguish between the throttle and clutch not only by virtue of their different coloring, but also as a result of the different texture or feel of the surfaces of the control knobs used for the throttle and clutch.

Figure 2:
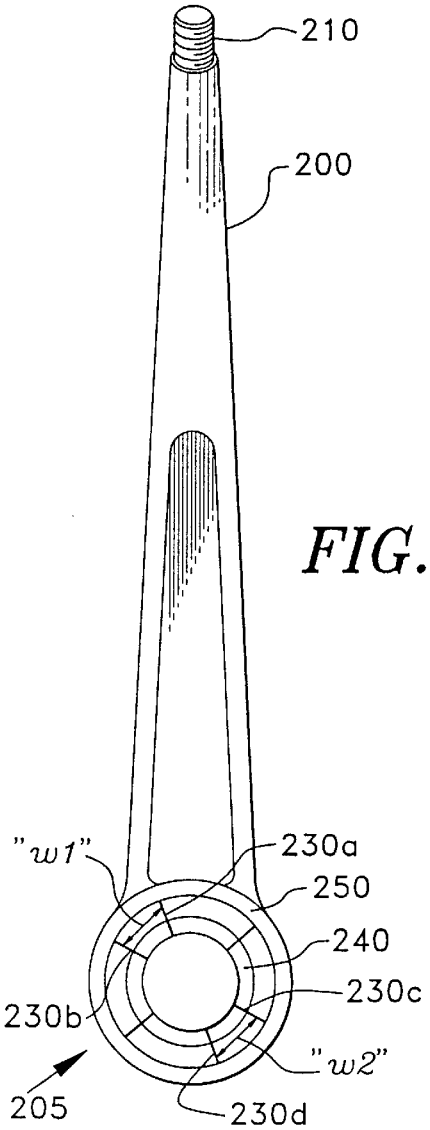
FIG. 2 is a front view of a control arm member, in accordance with a preferred embodiment of the present invention.
Figure 3:
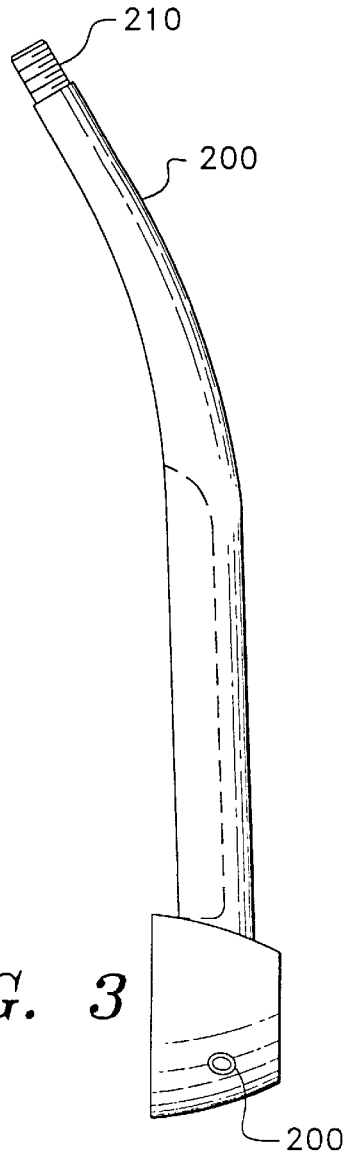
FIG. 3 is a side view of the control arm member shown in FIG. 2.
Figure 4:
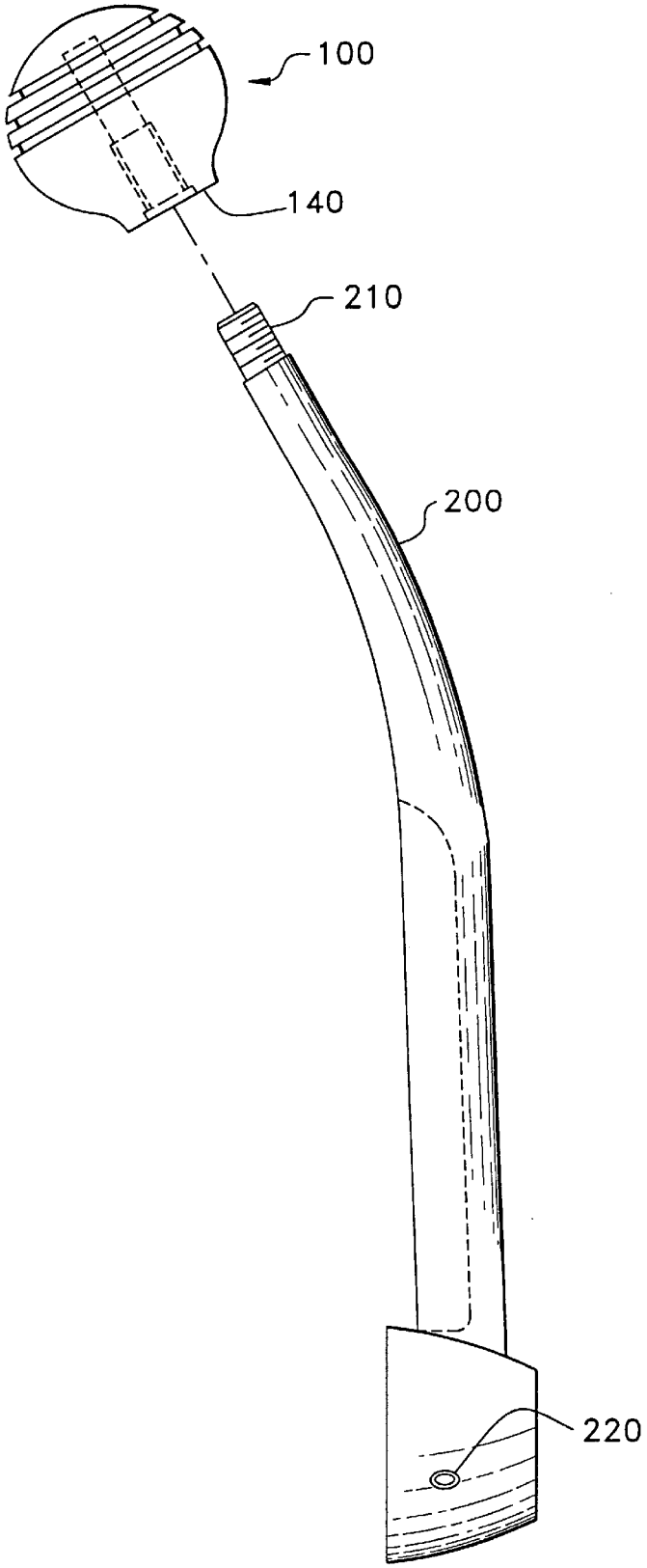
FIG. 4 is an exploded side view showing a control arm member together with a control knob, in accordance with a preferred embodiment of the present invention.

Referring now to FIGS. 2 and 3, there are shown front and side views of an elongated control arm member 200 for use with the control knob 100 of the present invention. Control arm member 200 includes a threaded portion 210 at its upper end. Control knob 100 includes a threaded insert 140 (shown in FIGS. 1 and 4) for receiving the threaded portion 210 of the control arm 200. The control knob 100 is rigidly affixed to control arm member 200 during use by aligning the threaded insert 140 and the threaded portion 210 (as shown in FIG. 4), and then screwing the threaded insert 140 and the threaded portion 210 together.

The control arm member 200 includes a hollow shell 205 at its base. The hollow shell 205 includes four internal guides 230*a*, 230*b*, 230*c*, 230*d*. Each of the internal guides 230*a–d* extends from an outer surface 250 of the hollow shell 205 to an inner surface 240 of the hollow shell. The first and second internal guides 230*a*, 230*b* are separated by a first distance "w1", and the third and fourth internal guides 230*c*, 230*d* are separated by a second distance "w2". In the preferred embodiment, w1 and w2 are equal. The hollow shell 205 is sized to receive an insert 300 (shown in FIGS. 5–7) having a plurality of knurls 320 for mating with grooves in a throttle assembly 400 (shown in FIGS. 8–9). As explained more fully below, the control arm member 200 and the insert 300 are each casted separately from stainless steel, after which, the insert 300 is positioned within the hollow shell 205 of the control arm member.

Figure 5:
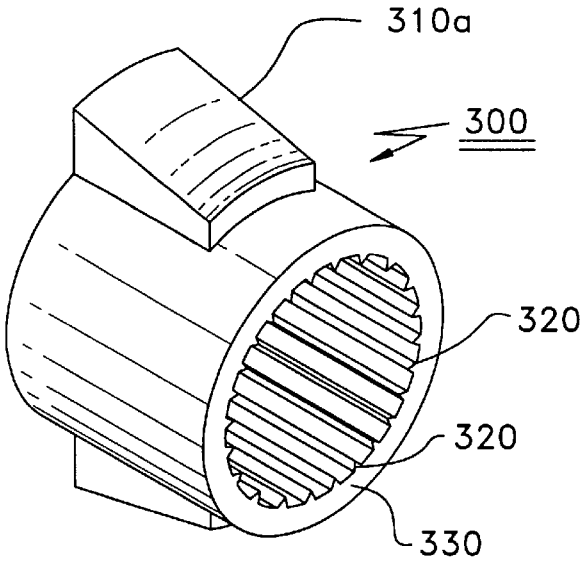
FIG. 5 is an isometric view of a knurl insert for use with the control arm member shown in FIG. 2, in accordance with a preferred embodiment of the present invention.
Figure 6:
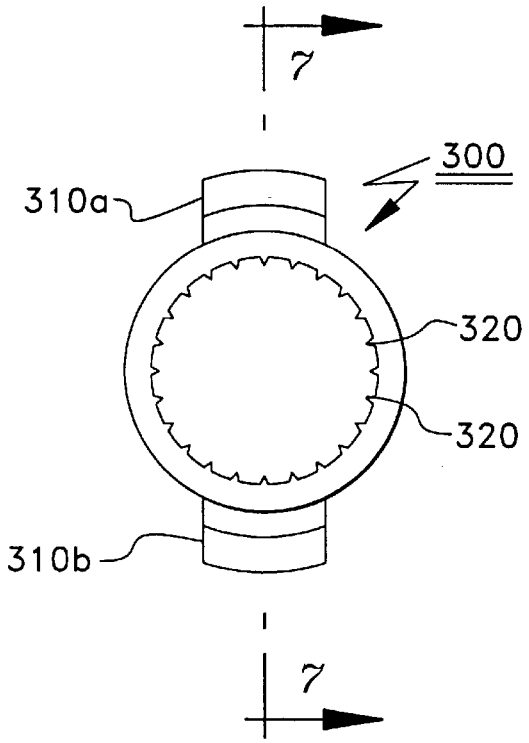
FIG. 6 is a front view of the knurl insert shown in FIG. 5.
Figure 7:
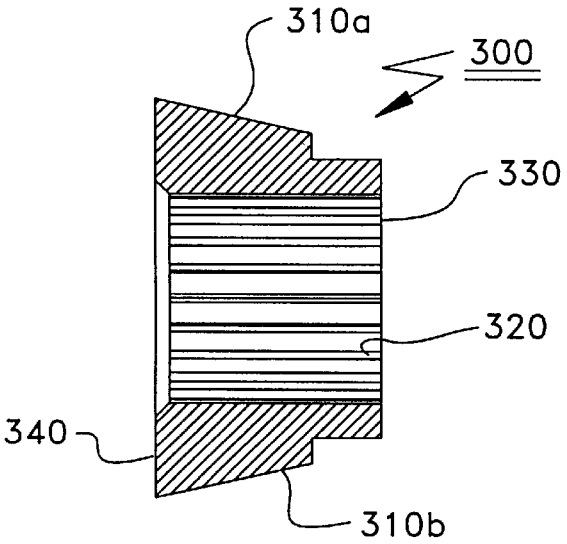
FIG. 7 is a cross-sectional view of the knurl insert shown in FIG. 6.

Referring now to FIGS. 5–7, the insert 300 has first and second wings 310*a*, 310*b* for positioning the insert 300 within the hollow shell 205. The first wing 310*a* has a first width corresponding to the distance w1 between guides 230*a* and 230*b*, and the second wing 310*b* has a second width corresponding to the second distance w2 between guides 230*c* and 230*d*. The insert 300 has an inner surface 330 and an outer surface 340. During the assembly of a control arm in accordance with the present invention, the insert 300 is positioned within the hollow shell 205 such that (i) the first wing 310*a* is positioned between the first and second guides 230*a*, 230*b*, (ii) the second wing 310*b* is positioned between the third and fourth guides 230*c*, 230*d*, (iii) the inner surface 240 of the hollow shell 205 is positioned against the inner surface 330 of the insert 300, and (iv) the outer surface 340 of the insert 300 is positioned flush with the outer surface 250 of the hollow shell 205. After the insert 300 is positioned within the hollow shell 205 as set forth above, the insert 300 is welded inside the hollow shell 205.

Figure 8:
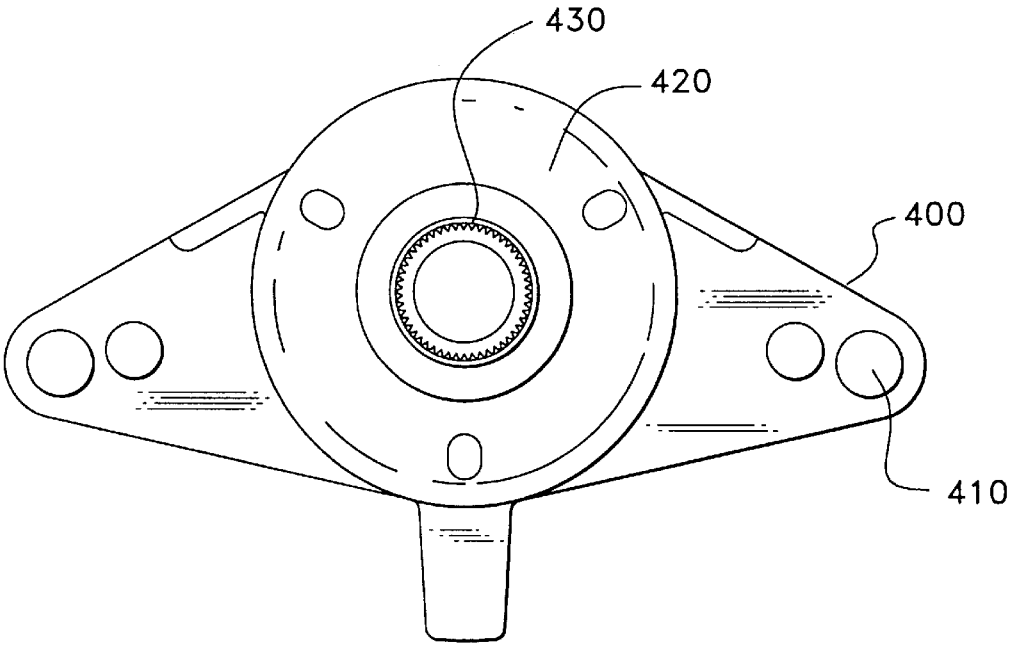
FIG. 8 is a front view of a throttle assembly for use with the control arm of the present invention.
Figure 9:
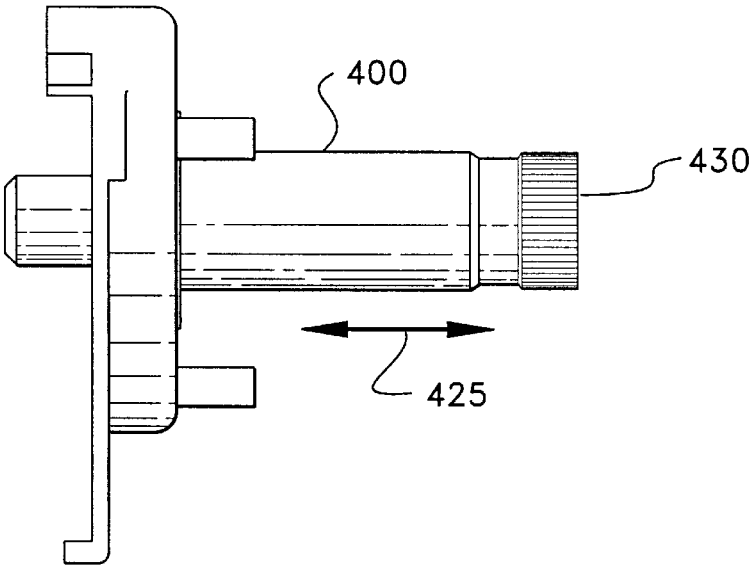
FIG. 9 is a side view of the throttle assembly shown in FIG. 8.
Figure 10:
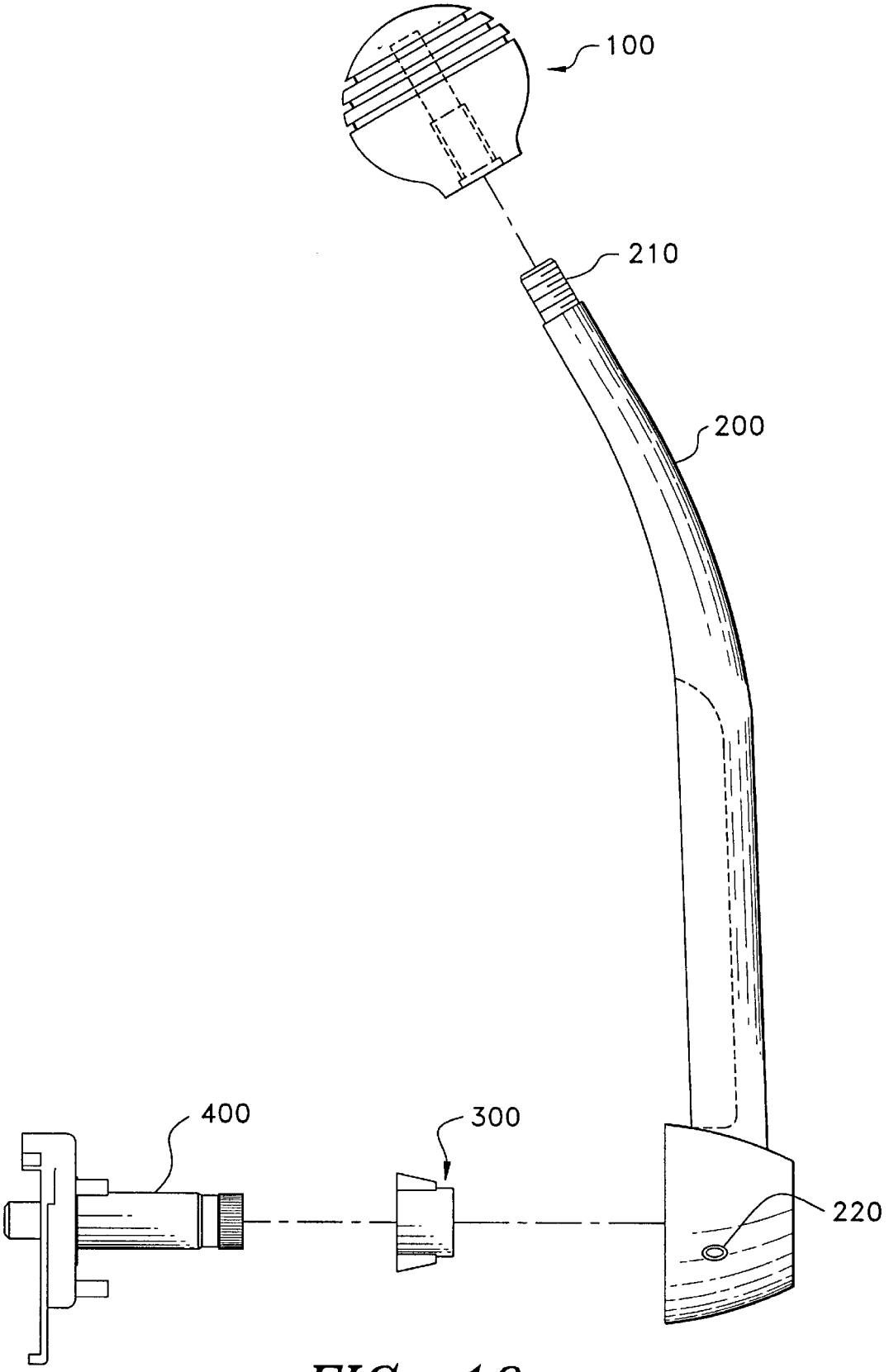
FIG. 10 is an exploded side view illustrating the interconnection of a control arm member a knurl insert, and a throttle assembly, in accordance with a preferred embodiment of the present invention.

Referring now to FIGS. 8–9, there are shown front and side views of a throttle (or clutch) assembly 400 for use with a control arm of the present invention. Assembly 400 includes a plurality of openings 410 for affixing assembly 400 to a marine control panel. A control cable (not shown) is affixed to a moveable wheel 420. The control cable couples the assembly 400 to either a marine motor or transmission. The assembly 400 includes a plurality of grooves or ridges 430 for mating with knurls 320 when a completed control arm (with an insert 300 welded thereon) is affixed to assembly 400. In a preferred embodiment (illustrated generally by FIG. 10), a set screw 220 is used to prevent the completed control arm from slipping along the axis identified as 425 when the knurls 320 are placed between the ridges 430 in assembly 400.

In the preferred embodiment of the present invention, the control knob 100 is hollow and weighs between 50 and 150 grams. In a still further preferred embodiment of the present invention, control knob 100 has a weight of 100 grams.

Furthermore, it is to be understood that although the present invention has been described with reference to a preferred embodiment, various modifications, known to those skilled in the art, may be made to the structures and process steps presented herein without departing from the invention as recited in the several claims appended hereto.

What is claimed is:

1. A marine control arm, comprising:

(A) an elongated arm member having a hollow shell with first, second, third and fourth internal guides, each of said internal guides extending from an outer surface of said hollow shell to an inner surface of said hollow shell, said first and second internal guides being separated by a first distance, said third and fourth internal guides being separated by a second distance; and (B) an insert having a plurality of knurls for mating with grooves in a throttle assembly, said insert having first and second wings for positioning said insert within said hollow shell, said first wing having a first width corresponding to said first distance, said second wing having a second width corresponding to said second distance, said insert having an inner surface and an outer surface;

wherein said first and second wings are tapered from said outer surface of said insert toward said inner surface of said insert;

wherein said insert is rigidly and permanently affixed within said hollow shell such that said first wing is positioned between said first and second guides, said second wing is positioned between said third and fourth guides, said inner surface of said hollow shell is positioned against said inner surface of said insert, and said outer surface of said insert is positioned flush with said outer surface of said hollow shell.

2. The marine control arm of claim 1, wherein said first distance is equal to said second distance.

3. The marine control arm of claim 2, further comprising a set screw for affixing said marine control arm to said throttle assembly.

4. The marine control arm of claim 3, further comprising a control knob affixed to said elongated arm member.

5. The marine control arm of claim 4, said control knob having a generally spherical outer surface, said generally spherical outer surface being formed from an unindented surface and at least one indented surface, said indented surface being generally closer to a centroid of said control knob than said unindented surface, wherein said indented surface has a colorized pigment deposited thereon.

6. The marine control arm of claim 5, wherein said indented surface is formed from first, second and third concentric rings.

7. The marine control arm of claim 6, wherein said colorized pigment is red and is deposited only on said indented surface.

8. The marine control arm of claim 6, wherein said colorized pigment is black and is deposited only on said indented surface.

9. The marine control arm of claim 1, wherein said elongated arm member and said insert are formed from stainless steel.

* * * * *